United States Patent [19]

Miyashita et al.

[11] 4,167,321

[45] Sep. 11, 1979

[54] PHOTOSENSITIVE DRUM FOR ELECTROGRAPHIC APPARATUS

[75] Inventors: Kiyoshi Miyashita; Katsuhiko Kimura, both of Hachioji, Japan

[73] Assignee: Olympus Optical Co., Ltd., Tokyo, Japan

[21] Appl. No.: 831,055

[22] Filed: Sep. 6, 1977

[30] Foreign Application Priority Data

Sep. 14, 1976 [JP] Japan ..... 51-123744[U]

[51] Int. Cl.[2] ..... G03G 15/00

[52] U.S. Cl. ..... 355/3 DR

[58] Field of Search ..... 355/3 R, 3 DR, 3 SC

[56] References Cited

U.S. PATENT DOCUMENTS

| | | | |
|---|---|---|---|
| 3,826,570 | 7/1974 | Kolibas | 355/3 DR |
| 3,985,432 | 10/1976 | Hou et al. | 355/3 SC |

*Primary Examiner*—Fred L. Braun

*Attorney, Agent, or Firm*—Haseltine, Lake & Waters

[57] ABSTRACT

A photosensitive drum for electrographic apparatus composed of a drum-shaped photosensitive body and producing thereon an electrostatic latent image corresponding to a picture image of a manuscript to be reproduced. The apparatus comprises a mechanism for frictionally braking the rotation of the photosensitive drum.

2 Claims, 5 Drawing Figures

PHOTOSENSITIVE DRUM FOR ELECTROGRAPHIC APPARATUS

BACKGROUND OF THE INVENTION

This invention relates to a photosensitive drum for electrographic apparatus composed of a drum-shaped photosensitive body and producing thereon an electrostatic latent image corresponding to a picture image of a manuscript to be reproduced. In an electrographic apparatus for exposing and scanning a picture image of a manuscript to be reproduced for the purpose of producing, on a photosensitive drum composed of a drum-shaped photosensitive body, an electrostatic latent image corresponding to the picture image of the manuscript and for transferring the electrostatic latent image to a record sheet, a carriage on which is placed the manuscript or an optical system for exposing the manuscript is reciprocated so as to expose and scan the manuscript and produce on the photosensitive drum the electrostatic latent image corresponding to the manuscript. The photosensitive drum is mainly composed of a drum-shaped photosensitive body.

In the course of producing, on the photosensitive drum, the electrostatic latent image corresponding to the picture image of the manuscript, it is important to effect the exposure and scanning movement in synchronism with the rotation of the photosensitive drum, that is, not only to make the start and stop positions of both the exposure and scanning movement and the rotation of the photosensitive drum always constant, but also to make the scanning speed equal to the rotary speed of the photosensitive drum.

In general, a gear mechanism for driving both the manuscript carriage or the optical system for exposing the manuscript and the photosensitive drum includes a pulley, wire, gear train, etc. But, the inertia of a gear mechanism for driving the manuscript carriage or the optical system for exposing the manuscript is different from the inertia of a gear mechanism for driving the photosensitive drum. As a result, there is a risk of both the driving mechanisms being subjected to play, motionless tension by backlash, etc. of the gears. In addition, the start and stop positions of both the manuscript carriage or the optical system for exposing the manuscript and the photosensitive drum are not always the same and come out of synchronism, thereby shifting the picture image reproduced.

SUMMARY OF THE INVENTION

An object of the invention, therefore, is to provide a photosensitive drum for electrographic apparatus which can significantly alleviate the above mentioned drawbacks which have been encountered with the prior art techniques and which can rotate the photosensitive drum substantially in synchronism with the reciprocating motion of the manuscript carriage or the optical system for exposing the manuscript without producing any play during rotation of the photosensitive screen.

A feature of the invention is the provision, in a photosensitive drum for electrographic apparatus composed of a drum-shaped photosensitive body and producing thereon an electrostatic latent image corresponding to a picture image of a manuscript to be reproduced, of the improvement comprising means for frictionally braking the rotation of the photosensitive drum.

The invention will now be described in greater detail with reference to the accompanying drawings.

DESCRIPTION OF THE PREFERRED EMBODIMENTS

Figure 1:
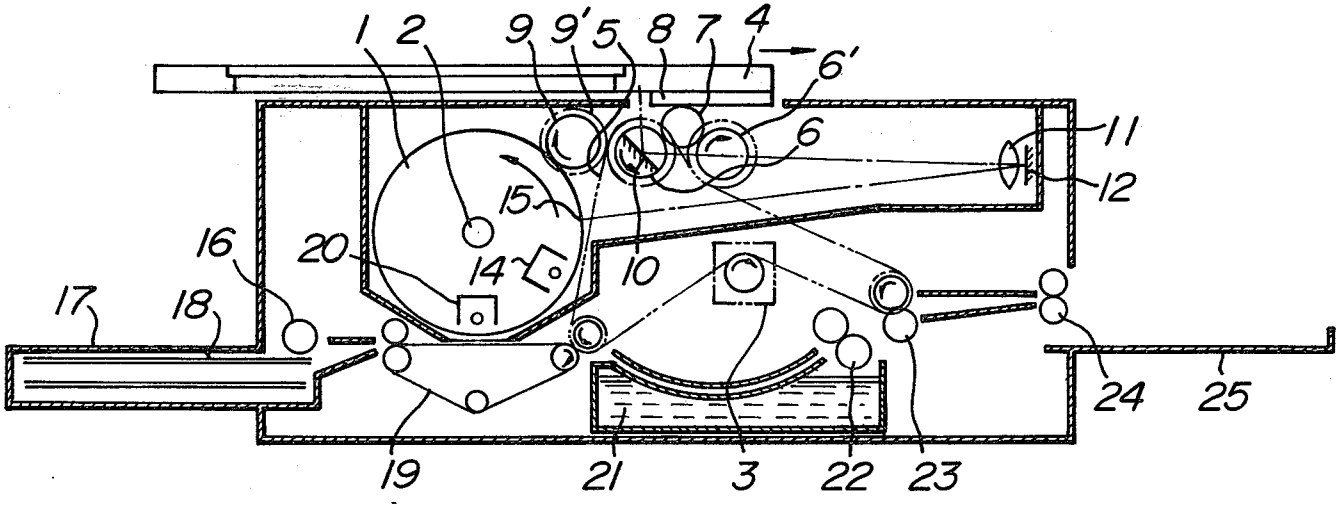
FIG. 1 Is a schematic view of one embodiment of an electrographic apparatus comprising a photosensitive drum according to the invention.

In FIG. 1 is shown one embodiment of an electrographic apparatus which is provided with a photosensitive drum 1 according to the invention. In the present embodiment, the photosensitive drum 1 makes use of a photosensitive screen and is rotatably mounted on a fixed shaft 2.

Reference numeral 3 designates a motor for driving the photosensitive drum 1 and a carriage 4 on which is placed a manuscript. The driving force of the motor 3 is transmitted through a driving chain 5 to two chain wheels (not shown) coaxially secured to gears 6, 6' for driving the manuscript carriage 4. Between these chain wheels and the gears 6, 6' for driving the manuscript carriage 4 are arranged clutches (not shown), respectively, which operate to transmit the driving force transmitted thereto to the gears 6, 6' for driving the manuscript carriage 4 such that when either one of the gears 6, 6' for driving the manuscript carriage 4 is driven, the other gear is not driven. Both the gears 6, 6' for driving the manuscript carriage 4 are threadedly engaged with a common gear 7 in mesh with a rack 8 secured to the manuscript carriage 4.

Coaxially with the chain wheel for the gear 6 for driving the manuscript carriage 4 is arranged a gear (not shown) for driving the photosensitive drum 1 and in mesh with an intermediate gear 9' for driving the photosensitive drum 1. Coaxially with the intermediate gear 9' is arranged a gear 9 for driving the photosensitive drum 1. The driving force applied to the intermediate gear 9' is transmitted through a clutch (not shown) to the gear 9. The gear 9 is threadedly engaged with a gear teeth provided around the periphery of the photosensitive drum 1.

Various parts of the electrographic apparatus shown in FIG. 1 are now ready for operation. In this case, the motor 3 is rotating, but all of the clutches for the gears 6, 6', 9 operate to permit these gears to disengage from the driving chain 5, thereby not driving the manuscript carriage 4 and the photosensitive drum 1. If a manuscript is placed on the manuscript carriage 4 with a side to be reproduced facing downwardly and then an operating button is pushed, the clutch for the gear 6 for driving the manuscript carriage 4 permits the gear 6 to engage with the driving chain 5, thereby rotating the gear 6 in a counterclockwise direction shown by the arrow. As a result, the common gear 7 in mesh with the gear 6 is rotated to forwardly move the manuscript carriage 4 through the rack 8 in mesh with the gear 7 in a direction shown by the arrow. An illumination lamp (not shown) for illuminating the manuscript is ignited in synchronism with the forward movement of the manuscript carriage 4 so as to illuminate the manuscript. A light reflected from the manuscript is incident through a reflecting mirror 10, a projection lens 11 and a reflecting mirror 12 on the photosensitive drum 1. In synchronism with the forward movement of the manuscript carriage 4, the clutch for the gear 9 operates to permit the gear 9 to engage with the driving chain 5, thereby rotating the gear 9 and hence the photosensitive drum 1 in a counterclockwise direction as shown by the arrow. The photosensitive drum 1 is uniformly charged by means of a first corona discharge device 14 arranged near the inner periphery of the photosensitive drum 1. Subsequently, if the photosensitive drum 1 is illuminated with the light image of the manuscript, on a photoconductive layer provided on the outer periphery of the photosensitive drum 1, there is produced an electrostatic latent image corresponding to the light image of the manuscript.

In this way, on the outer periphery of the photosensitive drum 1 rotating in synchronism with the forward movement of the manuscript placed on the manuscript carriage 4 and scanned by the light image of the manuscript, there is produced the electrostatic latent image corresponding to the light image of the manuscript and the photosensitive drum 1 arrives at the end of its first rotation and becomes ready for starting its second rotation.

If the photosensitive drum 1 starts its second rotation, a record sheet feed roller 16 becomes operated to deliver a record sheet 18 enclosed in a cassette 17 onto a conveyor belt 19. Then, the record sheet 18 on the conveyor belt 19 arrives at a position immediately below a second corona discharge device 20 which operates to charge the photosensitive drum 1 with a polarity which is opposite to that of the first charge effected by the first corona discharge device 14, thereby transferring the electrostatic latent image on the photosensitive drum 1 onto the record sheet 10 and producing thereon an electrostatic charge. If the photosensitive drum 1 arrives at the end of its second rotation, the clutch for the gear 9 operates to permit the gear 9 to disengage from the driving chain 5, thus stopping the photosensitive drum 1.

The record sheet 18 with the electrostatic charge transferred thereon is fed through a developing device 21, a squeezing roller 22 and a suction roller 23 to a delivery roller 24 from which is delivered the record sheet 18 with a visible picture image into a copy container 25.

The conveyor belt 19 and suction roller 23 are driven through the chain 5 from the motor 3. In the course of the second rotation of the photosensitive drum 1, the clutch for the gear 6 operates to permit gear 6 to disengage from the driving chain 5 so as to stop the forward movement of the manuscript carriage. Then, the clutch for the gear 6′ operates to permit the gear 6′ to engage with the driving chain 5. The gear 6′ is rotated in a direction opposite to the direction of rotation of the gear 6 so as to backwardly move the manuscript carriage 4 through the common gear 7 in mesh with the gear 6′ and the rack 8 in mesh with the common gear 7. When the manuscript carriage 4 is returned to its original position, the clutch for the gear 6′ operates to permit the gear 6′ to disengage from the driving chain 5, thus stopping the manuscript carriage 4.

Figure 2A:
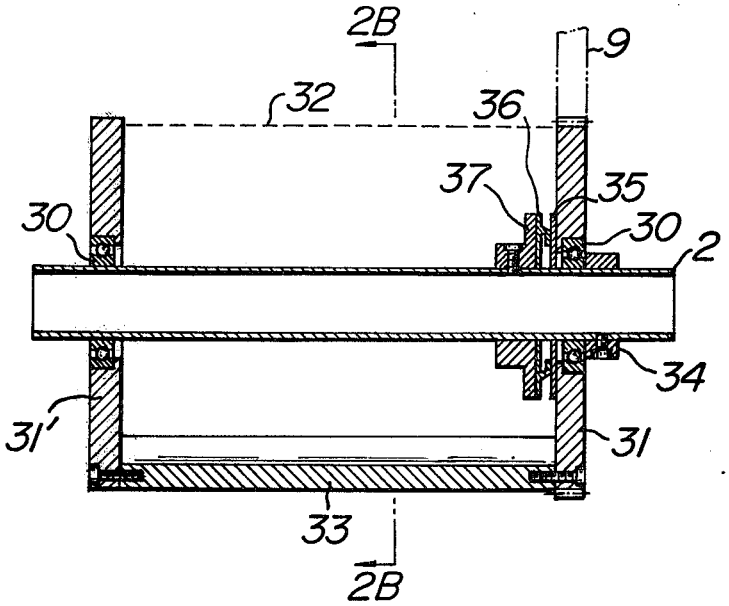
FIG. 2A is a cross sectional view of one embodiment of a photosensitive drum according to the invention.
Figure 2B:
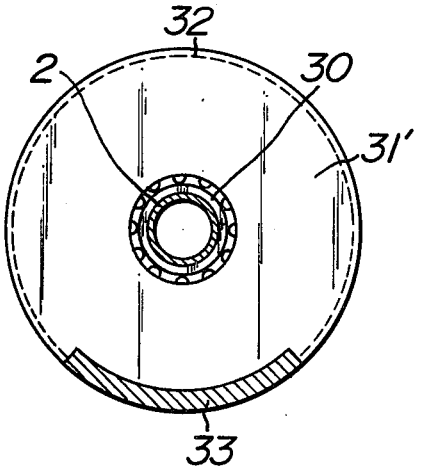
FIG. 2B is a section taken on line 2B—2B of FIG. 2A.

In FIGS. 2A and 2B is shown one embodiment of a photosensitive drum according to the invention. A pair of flanges 31, 31′ spaced apart from each other are rotatably journaled in bearings 30, 30 mounted on a fixed shaft 2. Around the outer periphery of the flanges 31, 31′ is mounted a photosensitive screen 32 composed of an etched foil. These two flanges 31, 31′ are connected with each other by means of a segment-shaped stay 33. The flange 31 is provided at its outside with a thrust ring 34 secured to the fixed shaft 2 for preventing the flange 31 from axially moving.

Figure 3:
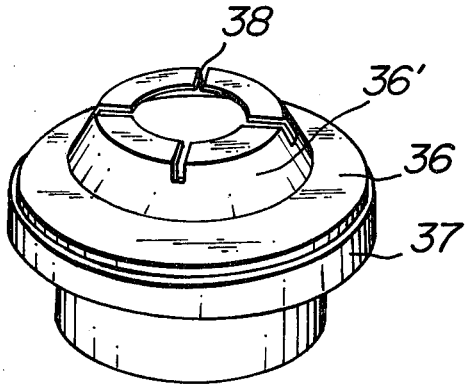
FIG. 3 is a perspective view of one embodiment of a frictional brake device.

In addition, the flange 31 is provided at its outer periphery with a gear which is engaged with and driven by the gear 9. The flange 31 is provided at its inside surface with a frictional brake device including a brake plate 35 frictionally engaged with the flange 31 and a brake spring 36 frictionally engaged with both the brake plate 35 and with a spring seat 37 secured to the fixed shaft 2. The brake spring 36 is provided at its center with a cone frustum 36′ with its upper portion divided into segments by means of slits 38 as shown in FIG. 3. The cone frustum 37 is urged against and frictionally engaged with the brake plate 35, thereby applying a braking force to the photosensitive drum 1. It is preferable that the brake plate 35 be formed, for example, of a thrust type DU bearing. It is possible to easily obtain the desired brake force by suitably selecting the configuration of the brake spring 36.

Figure 4:
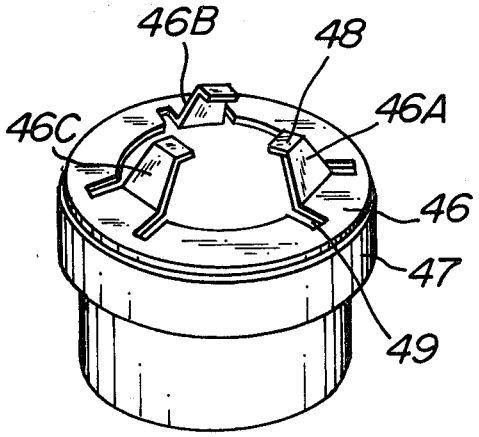
FIG. 4 is a perspective view of a modified embodiment of the frictional brake device shown in FIG. 3.

In FIG. 4 is shown a modified embodiment of the frictional brake device shown in FIG. 3. In the present embodiment, a brake spring 46 is composed of an annular ring frictionally engaged with a spring seat 47 and provided at its inner periphery with three projecting pieces 46A, 46B, 46C equally spaced apart from each other and made integral with an annular ring. The upper end 48 of each of these projecting pieces 46A, 46B, 46C is bent inwardly so as to form a flat contact surface with the brake plate 35. In addition, the brake spring 46 is provided at the lower end of each of the projecting pieces 46A, 46B, 46C with a slit 49 so as to provide a sufficiently large spring action.

As stated hereinbefore, the use of means for rotating the photosensitive screen while braking it provides the important advantage that it is possible to easily alleviate the drawbacks that the inertia force produced when rotation of the photosensitive drum becomes significantly irregular due to unbalance in weight of the photosensitive drum provided at one part of the periphery thereof with the segment-shaped stay 33, that the rotation of the photosensitive drum comes out of synchronism with the reciprocating motion of the manuscript carriage or the optical system for exposing the manuscript due to interruption of rotation occurs when the inertia force of the photosensitive drum becomes different from that of the manuscript carriage or the optical system, and that the position at which the photosensitive drum is stopped becomes variable.

The invention is not limited to the above described embodiments and many changes and alternations may be made. For example, the photosensitive drum is not limited to a photosensitive screen and may be composed of any other type of photosensitive drum. In addition, the frictional brake device is not limited to such construction as shown in the drawings.

The photosensitive drum according to the invention is capable of obviating means for precisely providing dynamic balance which is very difficult to be achieved for the photosensitive screen etc. In addition, in a PPC type electrographic apparatus, its photosensitive drum is generally large in diameter and the moment of inertia tends to be irregular and large in amount. The invention is also capable of alleviating such drawbacks. In addition, the invention can not only obviate precise consideration in design in the case of effecting dynamic balance of the photosensitive drum, but it also obviates a time consuming adjustment of irregularity in the case of manufacturing the photosensitive drum. As a result, the invention can provide a photosensitive drum which is less expensive.

What is claimed is:

1. In a photosensitive drum for electrographic apparatus composed of a drum-shaped photosensitive body and means for producing thereon an electrostatic latent image corresponding to a picture image of a manuscript to be reproduced, the improvement comprising means for frictionally braking the rotation of said photosensitive drum comprising a frictional brake device including a brake plate frictionally engaged with a flange rotatably journaled in a bearing mounted on a fixed shaft and supporting said drum-shaped photosensitive body and a brake spring frictionally engaged with both said brake plate and with a spring seat secured to said fixed shaft and urged against said brake plate.

2. The photosensitive drum according to claim 1 and comprising further a common power source including a gear mechanism for driving both said photosensitive drum and a manuscript carriage on which is placed a manuscript or an optical system for exposing said manuscript.

* * * * *